US009534394B1

(12) United States Patent
Mettler et al.

(10) Patent No.: US 9,534,394 B1
(45) Date of Patent: Jan. 3, 2017

(54) PORTABLE MODULAR PEDESTRIAN RAMP

(71) Applicant: Plastic Safety Systems, Inc., Cleveland, OH (US)

(72) Inventors: Charles M. Mettler, Perry, OH (US); Gregory H. Brown, Chagrin Falls, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 0 days.

(21) Appl. No.: 14/847,429

(22) Filed: Sep. 8, 2015

(51) Int. Cl.
*E04F 11/00* (2006.01)
*E01D 15/12* (2006.01)
*E04F 11/18* (2006.01)

(52) U.S. Cl.
CPC ..... *E04F 11/002* (2013.01); *E01D 15/12* (2013.01); *E04F 11/18* (2013.01); *E04F 2011/005* (2013.01)

(58) Field of Classification Search
CPC ..... B65G 69/30; B60P 1/435; E04F 11/002; E04F 11/18; E04F 2011/005; E01D 15/12
See application file for complete search history.

(56) References Cited

U.S. PATENT DOCUMENTS 3,984,891 A * 10/1976 Weinmann ..... B65G 69/30 14/69.5
4,527,941 A * 7/1985 Archer ..... B60R 3/02 182/157
4,807,317 A * 2/1989 Quinn ..... E04F 11/002 14/69.5
5,347,672 A * 9/1994 Everard ..... A61G 3/061 14/69.5
5,446,937 A * 9/1995 Haskins ..... B65G 69/287 14/69.5
6,643,878 B2 * 11/2003 Schmaltz ..... A61G 3/061 14/69.5
8,397,329 B2 * 3/2013 Just ..... A61G 3/061 14/69.5
8,479,337 B1 * 7/2013 Morris ..... A61G 3/061 14/69.5
2003/0182740 A1 * 10/2003 Schmaltz ..... A61G 3/061 14/69.5
2006/0156492 A1 * 7/2006 Warford ..... A61G 3/061 14/69.5

* cited by examiner

*Primary Examiner* — Abigail A Risic
(74) *Attorney, Agent, or Firm* — Renner, Otto, Boisselle and Sklar LLP

(57) ABSTRACT

A portable modular pedestrian ramp comprises a plurality of modular ramp units. Each of the modular ramp units comprises a pair of side edge plates each having inwardly facing sides to which opposite ends of decking are attached. The side edge plates of at least some of the modular ramp units have opposite ends thereof that are releasably connectable to one another by self-locking connectors to provide different ramp lengths without the need for any tools or fasteners to join the modular ramp units together or disassemble the modular ramp units for transportation and storage.

19 Claims, 11 Drawing Sheets

PORTABLE MODULAR PEDESTRIAN RAMP

TECHNICAL FIELD

This invention relates generally to a portable modular pedestrian ramp that provides a transition between two different elevations such as a curb and street level for access routes around worksites or other locations that cross curbs.

BACKGROUND

There is a wide variety of portable ramps on the market for use in spanning two different or similar elevations. However, there is a need for a portable modular pedestrian ramp that is easily adjustable to different lengths on a job to accommodate different elevation changes including but not limited to different curb heights. The ramp can also serve to bridge a gap between two level surfaces.

SUMMARY

The present invention relates to a portable modular pedestrian ramp that is easily adjustable to different lengths to accommodate different elevation changes including but not limited to different curb heights, and/or to bridge a gap between two level surfaces.

In an embodiment, the portable pedestrian ramp comprises a plurality of modular ramp units, at least some of which have self-locking connectors to provide different ramp lengths without the need for any tools or fasteners to join the modular ramp units together or disassemble the modular ramp units for transportation and storage.

In an embodiment, fasteners are used to connect one or more of the modular ramp units together to create a base ramp length to which other modular ramp units may be connected by self-locking connectors when greater ramp lengths are needed.

In an embodiment, each modular ramp unit comprises a pair of side edge plates each having inwardly facing sides to which opposite ends of decking made of wood boards or other suitable decking material are attached using suitable fasteners including but not limited to wood screws extending through screw holes in the respective side edge plates.

In an embodiment, a shelf is provided on the inwardly facing sides of the respective side edge plates for supporting at least two wood boards that are located relative to one another by at least one rib on the inwardly facing sides of the side edges plates that extends orthogonal to the shelf.

In an embodiment, the portable modular pedestrian ramp includes a shorter top ramp unit to which one of the modular ramp units is pivotally connected for ease of placement of the top ramp unit at the higher elevation.

In an embodiment, approach plates are hingedly connected to outermost end edges of the decking at opposite ends of the ramp.

In an embodiment, one or more jack screw assemblies are used to support longer ramps.

DETAILED DESCRIPTION

Figure 1:
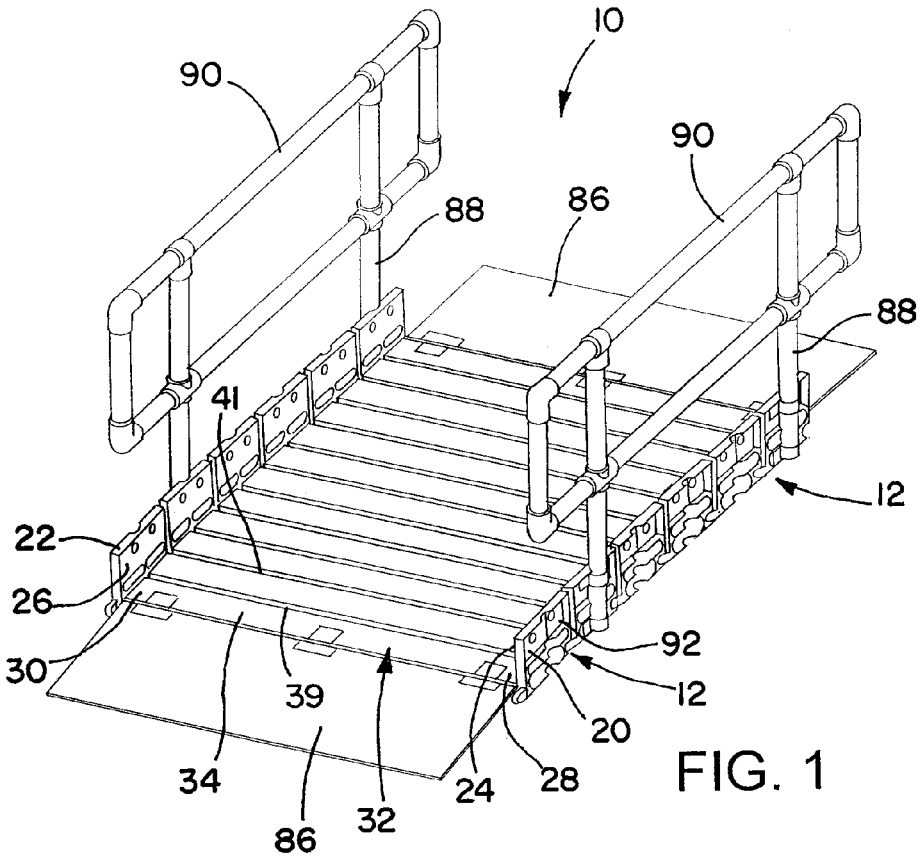
FIG. 1 is an upper left end perspective view of an embodiment of a portable modular pedestrian ramp comprised of multiple modular ramp units.
Figure 2:
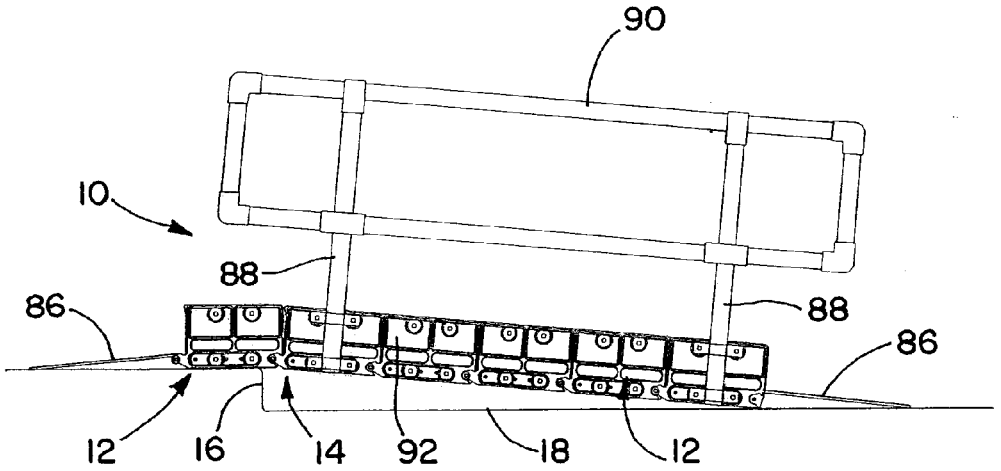
FIG. 2 is a right side elevation view of the ramp of FIG. 1 shown providing temporary ramping between two surfaces at different elevations for example a curb and street level.
Figure 3:
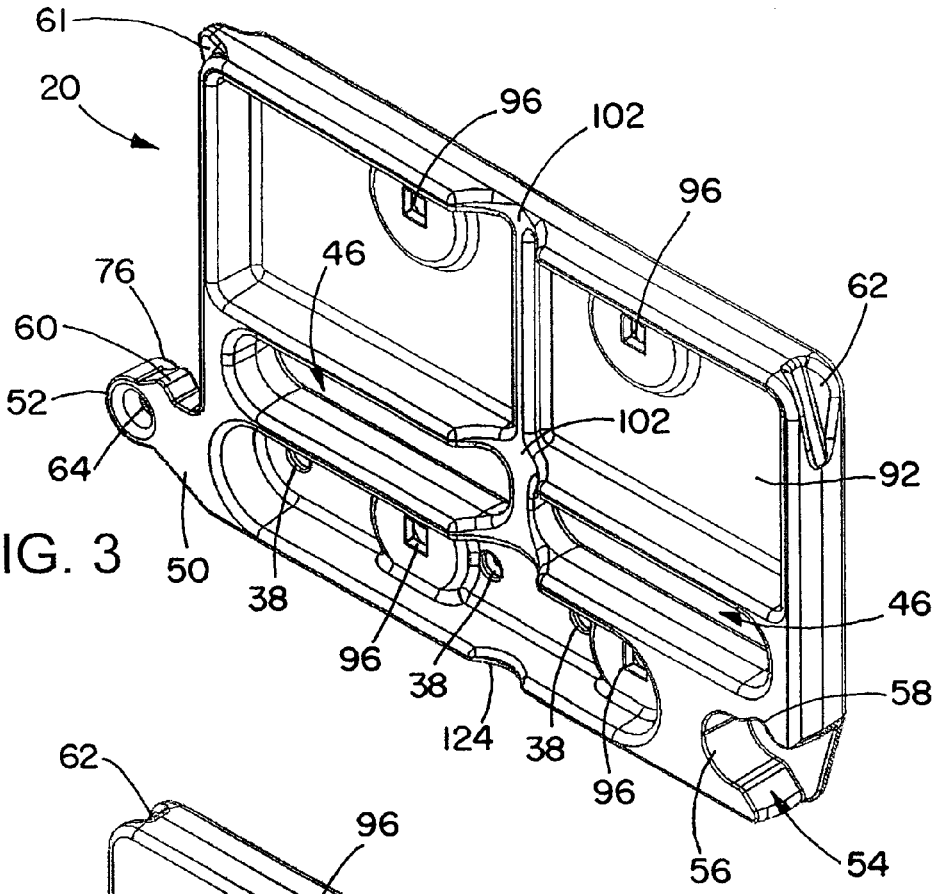
FIG. 3 is an enlarged perspective view of the outwardly facing side of the right side edge plate of one of the modular ramp units of FIGS. 1 and 2.

Referring now more particularly to the drawings, wherein the same reference numbers are used to designate like parts, and initially to FIGS. 1 and 2, there is shown a portable modular pedestrian ramp 10 in accordance with an embodiment herein comprising a plurality of modular ramp units 12 that are releasably connectable to one another without the need for any tools or fasteners by self-locking connectors 14 to provide different ramp lengths to accommodate different elevations between two surfaces including but not limited to curb and roadway surfaces 16, 18 as shown in FIG. 2, and to facilitate disassembly of the modular ramp units for transportation and storage. In the embodiment shown in FIGS. 1 and 2, each of the modular ramp units 12 comprises a pair of side edge plates 20, 22 each having inwardly facing sides 24, 26 to which opposite ends 28, 30 of decking 32 are attached.

Although the side edge plates 20, 22 may be made of different materials including but not limited to wood, metal or plastic, in an embodiment the side edge plates are made of cast iron which is very durable and strong enough, for example, to support the required load of 800 lbs. Also cast iron side edge plates are relatively inexpensive to manufacture, and have very little recycle value to cut down on theft, which can be a serious problem in some urban locations. The decking 32 may also be made of various materials including but not limited to metal, plastic or wood. However, in this embodiment the decking is comprised of wood boards 34, which also have very little recycle value.

Referring now more particularly to FIGS. 3-8, the height of the side edge plates 20, 22 and length of the decking 32 may vary within limits. However, in an embodiment, the side edge plates are approximately eight inches high to provide guidance for use of canes and walking devices by disabled individuals. Also in an embodiment, the wood decking has a width of between approximately four feet and five feet, which is safer for wheelchairs.

Moreover, while the length of the modular ramp units 12 may vary within certain limits, in an embodiment, the units have a length of approximately one foot, which allows the installer to add or remove modular ramp units of one foot increments to or from the pedestrian ramp. Also ramp units that are approximately one foot in length will readily accommodate two 2×6 inch wood boards 34 that may be attached thereto by wood screws 36 extending through wood screw holes 38 in the respective side edge plates 20, 22 (see FIGS. 7 and 8).

Figure 4:
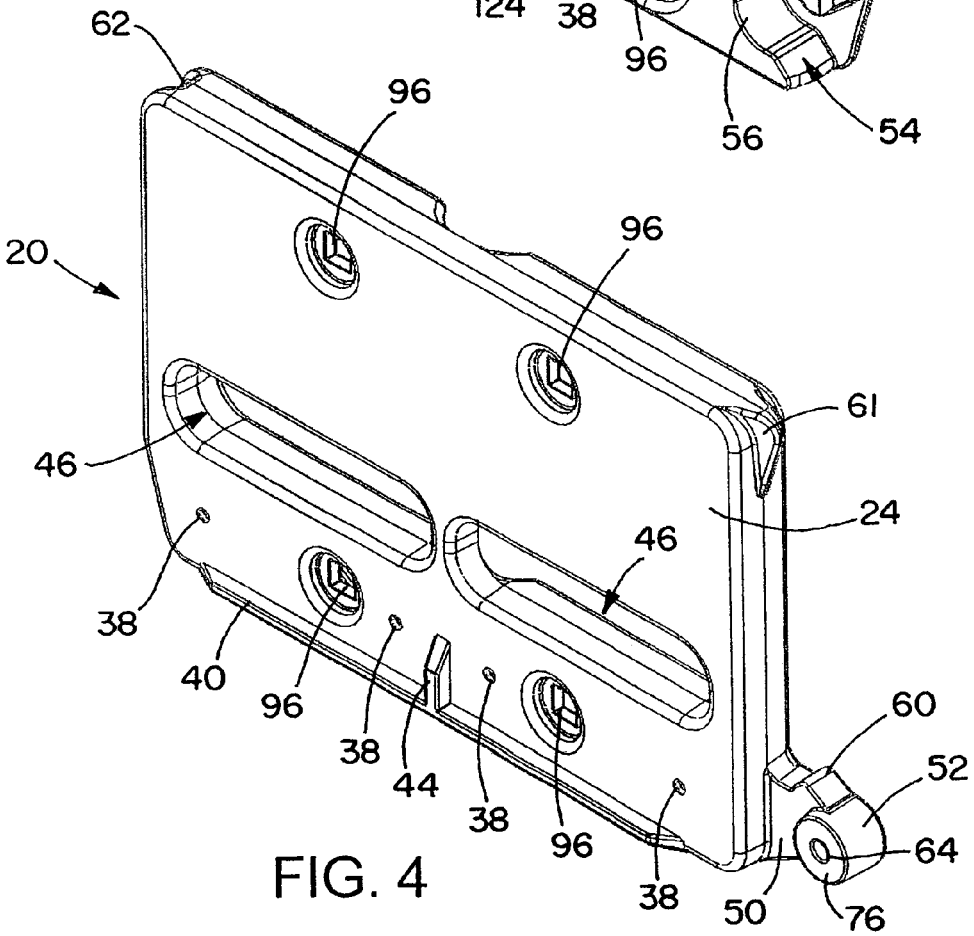
FIG. 4 is an enlarged perspective view of the inwardly facing side of the side edge plate of FIG. 3.
Figure 5:
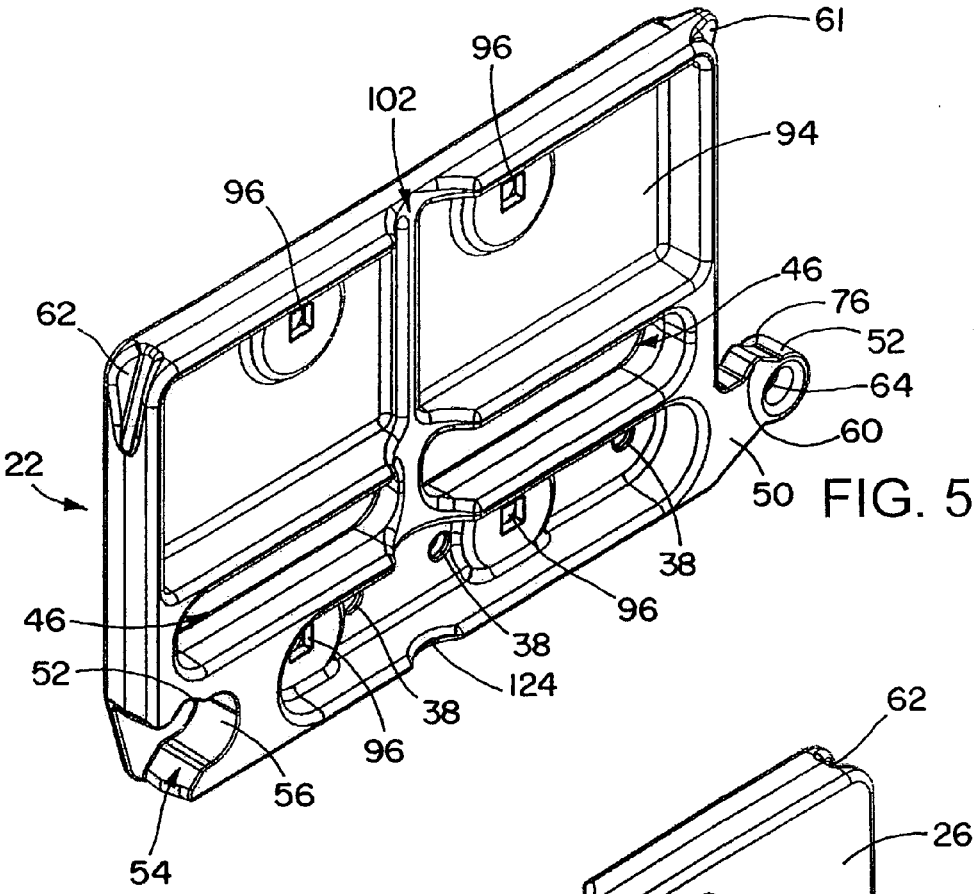
FIG. 5 is an enlarged perspective view of the outwardly facing side of the left side plate of one of the modular ramp units of FIG. 1 which is a mirror image of the right side edge plate.
Figure 6:
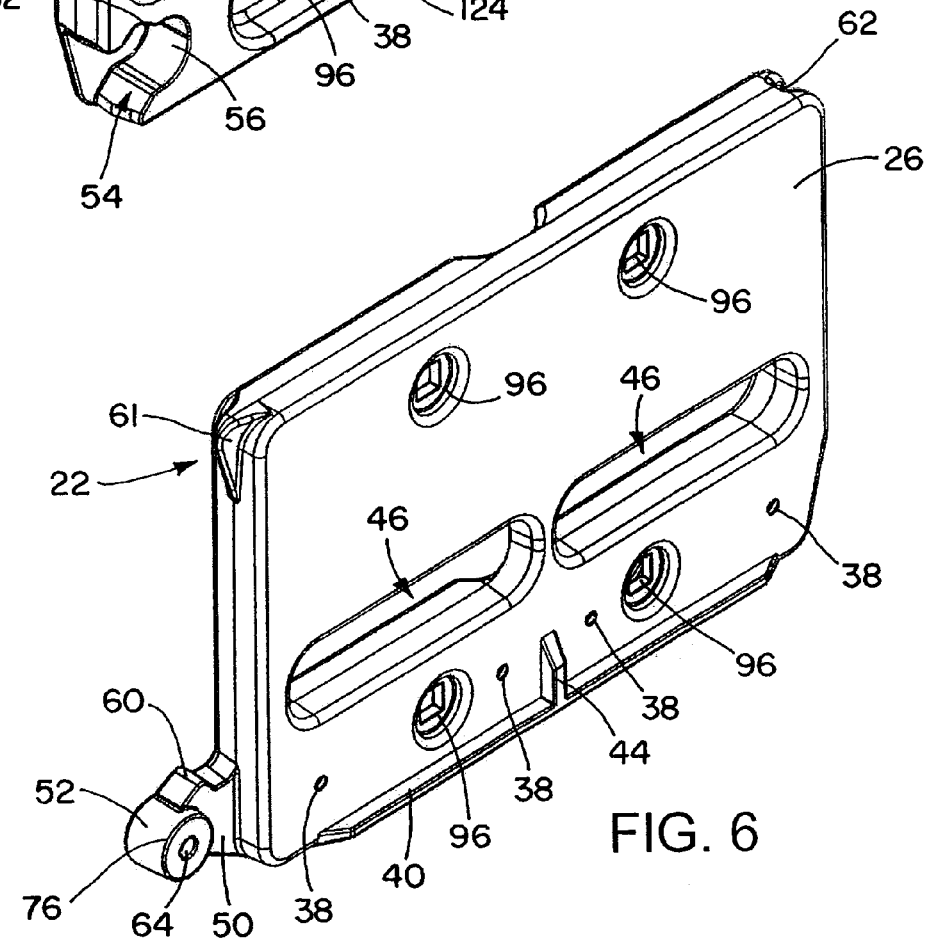
FIG. 6 is an enlarged perspective view of the inwardly facing side of the side edge plate of FIG. 5.

In an embodiment, a shelf 40 is provided on smooth inwardly facing sides 24, 26 of the respective side edge plates 20, 22 of each modular ramp unit 12 below the wood screw holes 38 as shown in FIGS. 4 and 6 for supporting the ends 28, 30 of the wood boards 34. Also in an embodiment, the wood boards 34 are located relative to one another against the inwardly facing sides of the respective side edge plates by a rib 44 on the inwardly facing sides that extends orthogonal to the shelf 40 as further shown in FIGS. 4 and 6.

When the modular ramp units 12 are approximately one foot in length and the decking comprises 2 inch×6 inch wood boards 34, there is a slight gap 39 between the two boards, for example, of approximately ⅛ inch, which corresponds to the approximate thickness of the rib 44 on the inwardly facing sides of the respective side edge plates that locates the two wood boards relative to one another. The gap 41 between the boards of adjacent modular ramp units will be somewhat larger, for example, up to approximately ⅜ inch (see FIG. 1).

In an embodiment, horizontal hand grip slots 46 are provided in the respective side edge plates 20, 22 above the respective screw holes 38 as shown in FIGS. 3-6.

Figure 9:
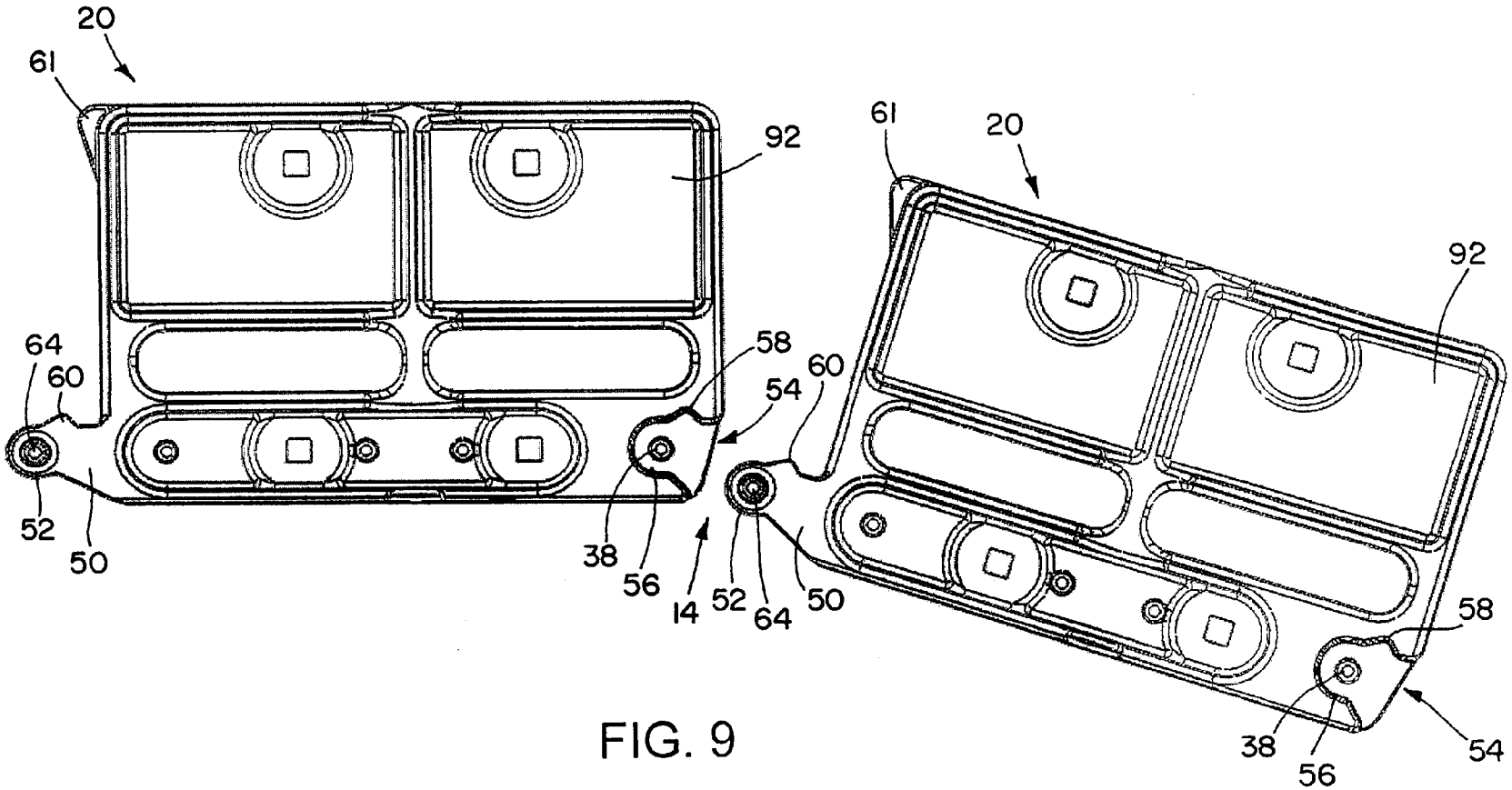
FIGS. 9-11 are enlarged side elevation views of the outwardly facing sides of two of the right side edge plates of FIG. 3 sequentially showing how the self-locking connectors of two of the modular ramp units of FIGS. 1 and 2 are connectable to one another.
Figure 10:
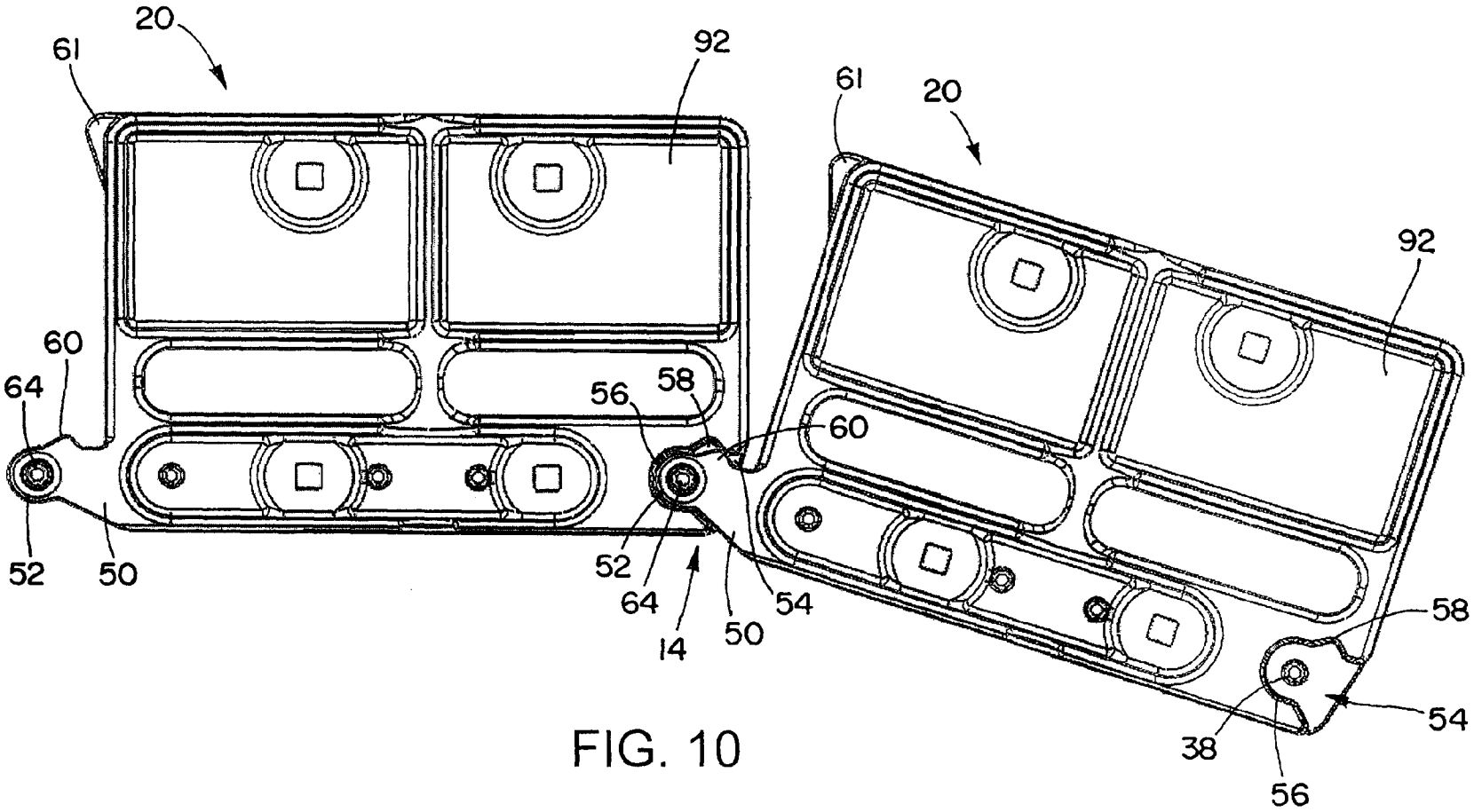
Figure 11:
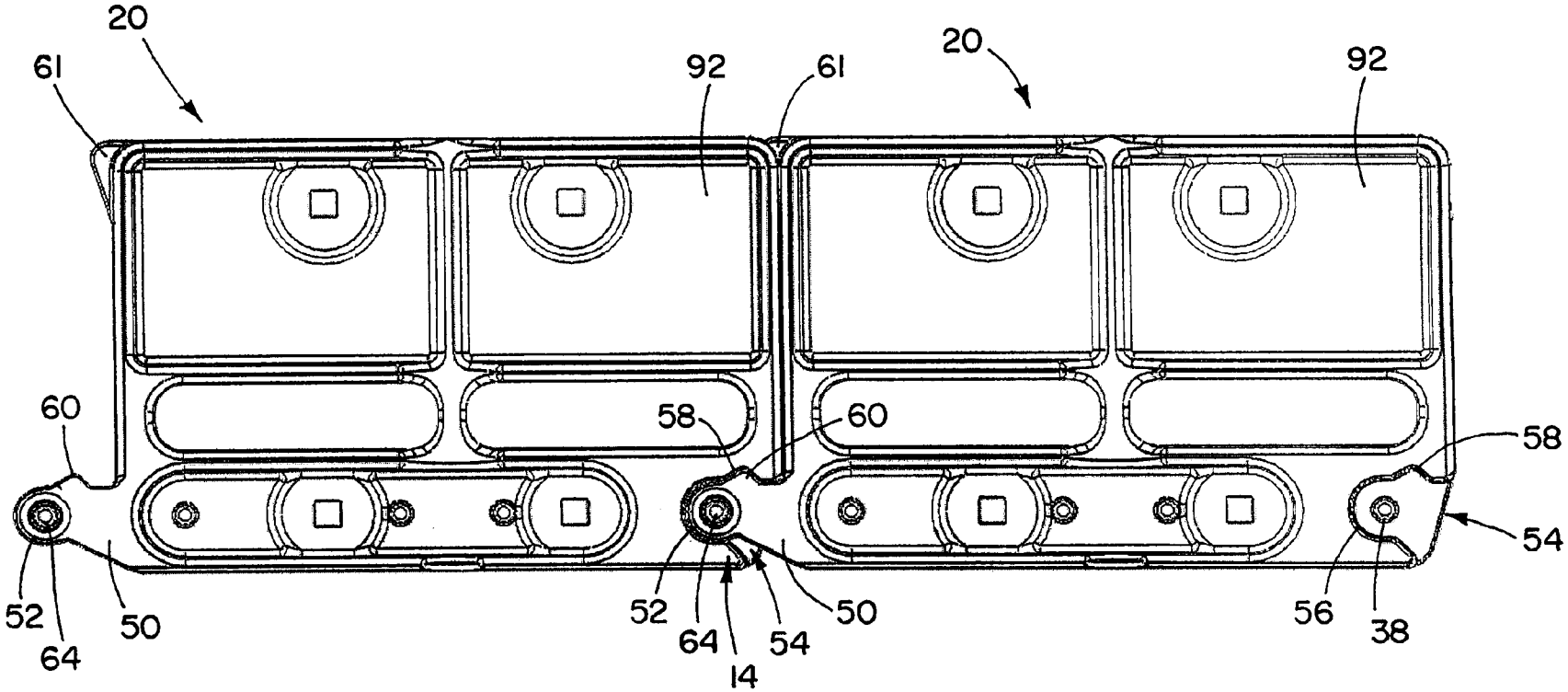

As best seen in FIGS. 9-11, in an embodiment, the respective self-locking connectors 14 for joining opposite ends of the side edge plates 20, 22 of a plurality of the modular ramp units 12 together without the need for any tools or fasteners comprises an arm 50 at one end of the respective side edge plates that angles upwardly and has a cylindrical shaped outer end 52, and an upwardly angled slot 54 in the other end that is wider than the arm 50 at the one end for ease of insertion of the cylindrical shaped outer end of the arm of the respective side edge plates of one of the modular ramp units into a complementary shaped semi-cylindrical recess 56 at the inner end of the wide angled slot 54 in the other end of the respective side edge plates of another of the modular ramp units when the arm and slot of the modular ramp units are angularly aligned relative to one another as shown in FIGS. 9 and 10. In the upper edge of the wide angled slot 54 is a notch 58 that is engageable by a complementary shaped projection 60 on an upper edge of the arm 50 (or vice versa) when the other end of the one modular ramp unit is lifted upwardly relative to the other modular ramp unit to lock the two modular ramp units together as shown in FIG. 11.

In an embodiment, when the notch 58 in the upper edge of the wide angled slot 54 in the side edge plates of the other modular ramp unit is fully engaged by the projection 60 on the upper edge of the arm 50 of the side edge plates of the one modular ramp unit, adjacent ends of the side edge plates of the two modular ramp units substantially abut one another as shown in FIG. 11.

In an embodiment, a locator projection 61 at the top end edge at one end of the respective side edge plates engages a corresponding slot 62 in the top end edge at the other end of the respective side edge plates (see FIGS. 3-6) when the adjacent ends of the respective side edge plates of two modular ramp units substantially abut one another as shown in FIG. 11 to prevent the ramp 10 from twisting under high loads/stress, keeping the side edge plates in a common vertical plane.

In an embodiment, one of the wood screw holes 38 through which a wood screw 36 is inserted for screwing into an end of one of the wood boards 34 for attachment to the inwardly facing sides 24, 26 of the respective side edge plates extends coaxially into the semi-cylindrical recess 56 at the inner end of the wide angled slot 54 in the other end of the respective side edge plates as shown in FIG. 9.

In an embodiment, two or more of the modular ramp units 12 may be securely joined together by inserting one of the wood screws 36 through a coaxial hole 64 in the cylindrical shaped outer end 52 of the arm 50 at one end of the respective side edge plates when brought into alignment with the wood screw hole 38 communicating with the semi-cylindrical recess 56 at the inner end of the wide angled slot 54 in the other end of the respective side edge plates of another modular ramp unit for threading into one of the wood boards to create a base ramp of a desired length, for example, four feet. Additional modular ramp units may be added to the base ramp using the self-locking connectors 14 where greater lengths are desired.

In an embodiment, a wood screw connection may be provided between the top modular ramp unit 12 and the adjacent modular ramp unit 12 to ensure that the adjacent modular ramp unit does not inadvertently become disengaged from the top modular ramp unit in the event that the adjacent modular ramp unit is angled downward relative to the top modular ramp unit at an angle of for example 30° or more. The actual slope angle is determined by the overall length of the other modular ramp units 12 which should preferably be long enough so the maximum slope angle does not exceed 4.76°.

Figure 12:
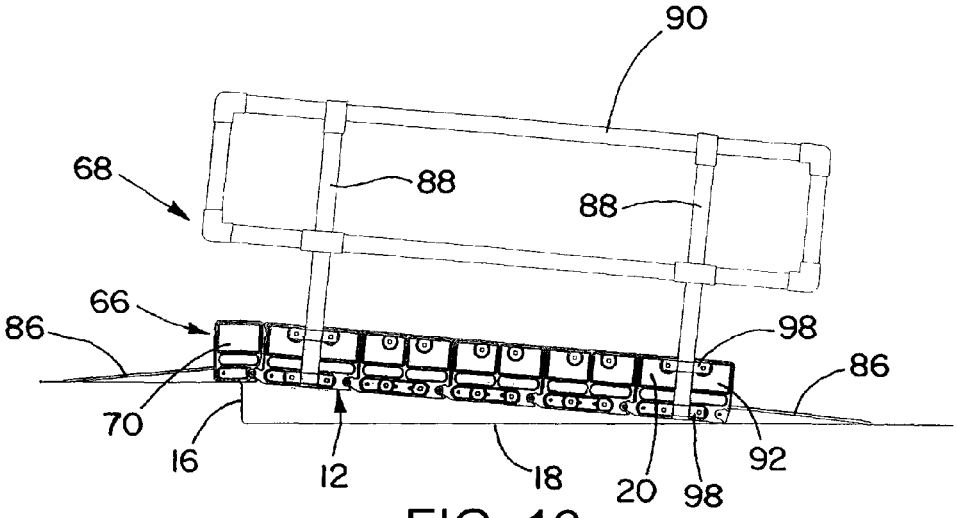
FIG. 12 is a right side elevation view of an embodiment of a portable modular pedestrian ramp which is similar to that shown in FIGS. 1 and 2 except for the top ramp unit that sits on top of the curb or other higher elevation which is shorter in length than the other ramp units.
Figure 13:
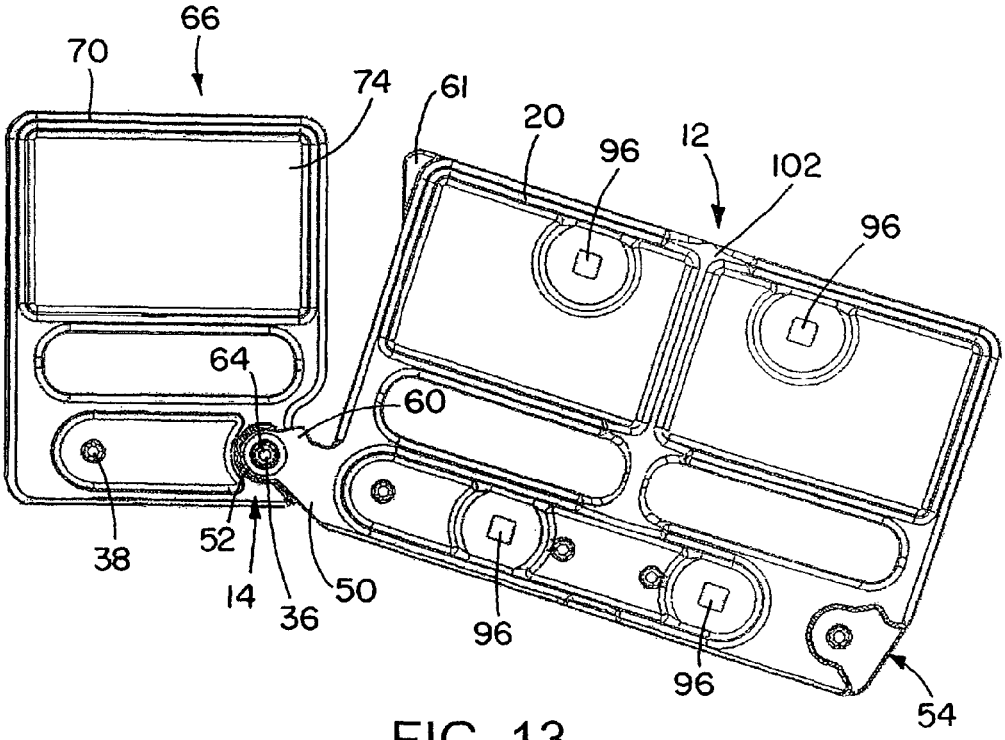
FIG. 13 is an enlarged side elevation view of the outwardly facing sides of the right side edge plate of the shorter top ramp unit and right side edge plate of one of the longer ramp units connected thereto.

In an embodiment shown in FIG. 12, the top ramp unit 66 of a portable modular pedestrian ramp 68 has respective side edge plates 70 of a shorter length than the side edge plates 20, 22 of the modular ramp units 12, for example, one-half the length of the side edge plates of the modular ramp units 12, for ease of placement of the top ramp unit 66 at the higher elevation (e.g., curb height).

Figure 14:
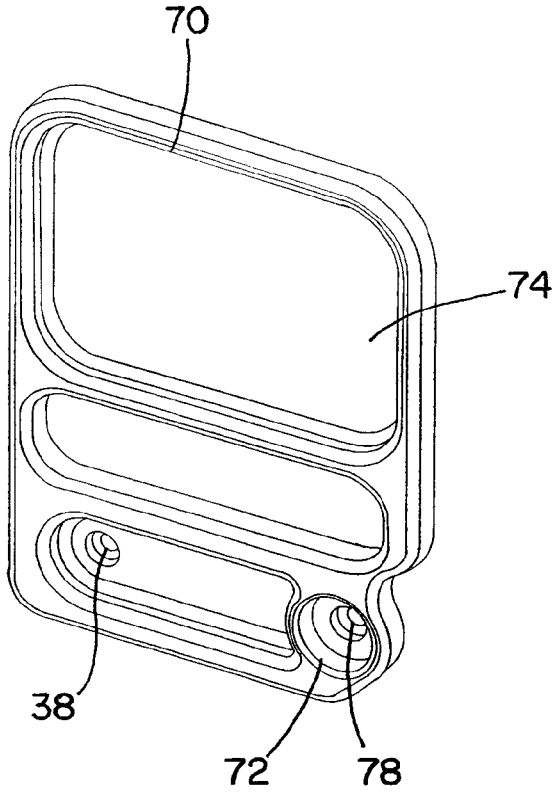
FIG. 14 is an enlarged perspective view of the outwardly facing side of the shorter right side edge plate of FIG. 13.

Each of the side edge plates 70 of the shorter top ramp unit 66 has a socket 72 (see FIG. 14) in the outwardly facing side 74 adjacent one end thereof for axial sliding receipt of the axial outer end portion 26 (see FIGS. 5-8) of the cylindrical shaped outer end 52 of the arm 50 at one end of the respective side edge plates 20, 22 of the modular ramp units 12, and is pivotally connected thereto by inserting one of the wood screws 36 through the coaxial hole 64 in the cylindrical shaped outer end of the arm at one end of the respective side edge plates of one of the modular ramp units and a hole 78 extending coaxially into the socket 72 in the respective shorter side edge plates as shown in FIG. 14 for screwing into the respective ends of the wood board decking for attachment to the inwardly facing sides of the shorter side edge plates.

Figure 15:
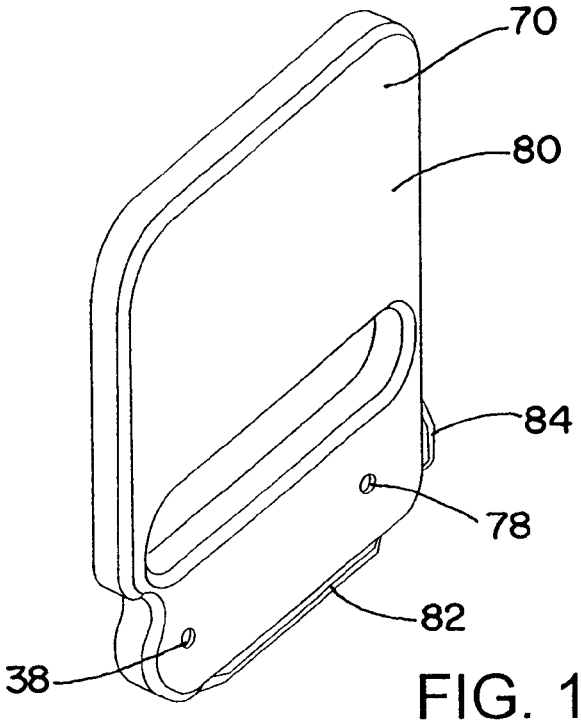
FIG. 15 is an enlarged perspective view of the inwardly facing side of the shorter right side edge plate of FIG. 14.

In an embodiment, the inwardly facing side 80 of the respective shorter side edge plates 70 of the top ramp unit 66 has a shelf 82 adjacent the bottom edge thereof for supporting the wood board decking 34 thereon and a flange 84 at the end opposite the socket 72 for locating the wood board relative to the shorter side edge plates 70 as shown in FIG. 15.

In an embodiment, metal approach plates 86 (see FIGS. 1, 2 and 12) having a dimension, for example, of approximately 18 inches by 48 inches are hingedly attached to the outermost end edges of the decking 32 at opposite ends of the respective modular pedestrian ramps. Also slip-resistant grip tape may cover the approach plates as well as the decking.

In an embodiment, handrail posts 88 for supporting handrails 90 are attached to the outwardly facing sides 92, 94 of at least some of the modular side edge plates 20, 22 by providing carriage bolt holes 96 in the side edge plates for attachment of handrail mounting post brackets 98 to the outwardly facing sides of the side edge plates using carriage bolts 100 as shown in FIGS. 1, 2, 7 and 12. Also FIGS. 3, 5, 8-11 and 13 show arcuate grooves 102 in the top edge and face of the outwardly facing sides 92, 94 orthogonal to a bottom edge of the side edge plates 22, 24 for locating the handrail posts 88 on the outwardly facing sides of the side edge plates.

Figure 7:
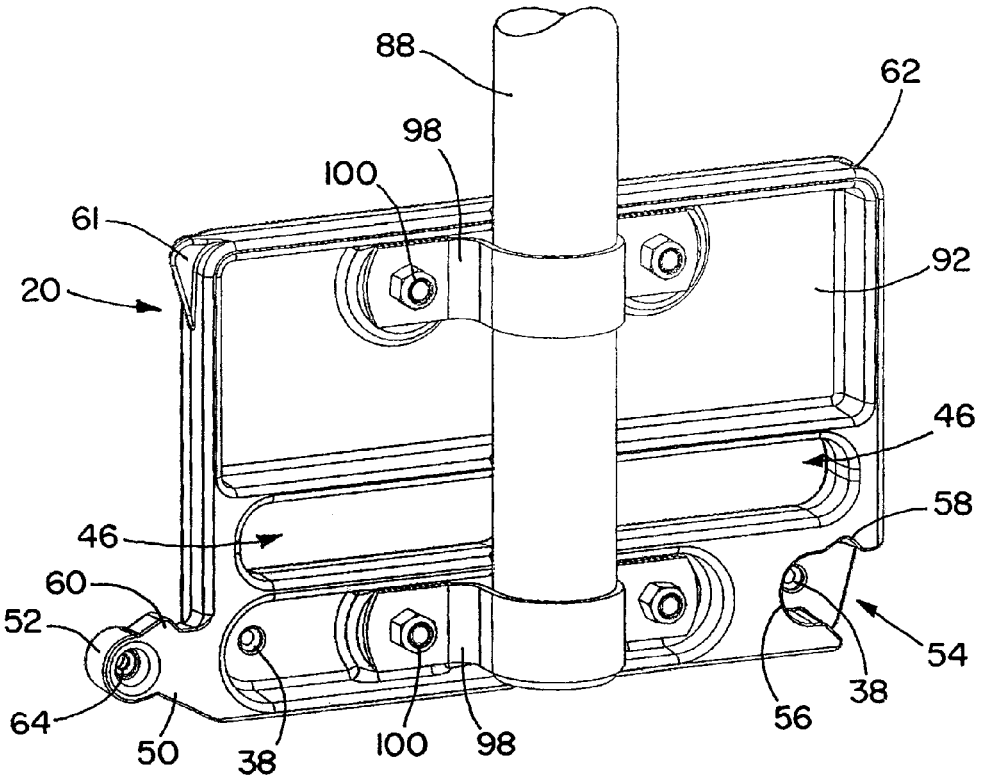
FIG. 7 is an enlarged perspective view of the outwardly facing side of the right side edge plate of FIG. 3 to which a handrail mounting post is attached.
Figure 8:
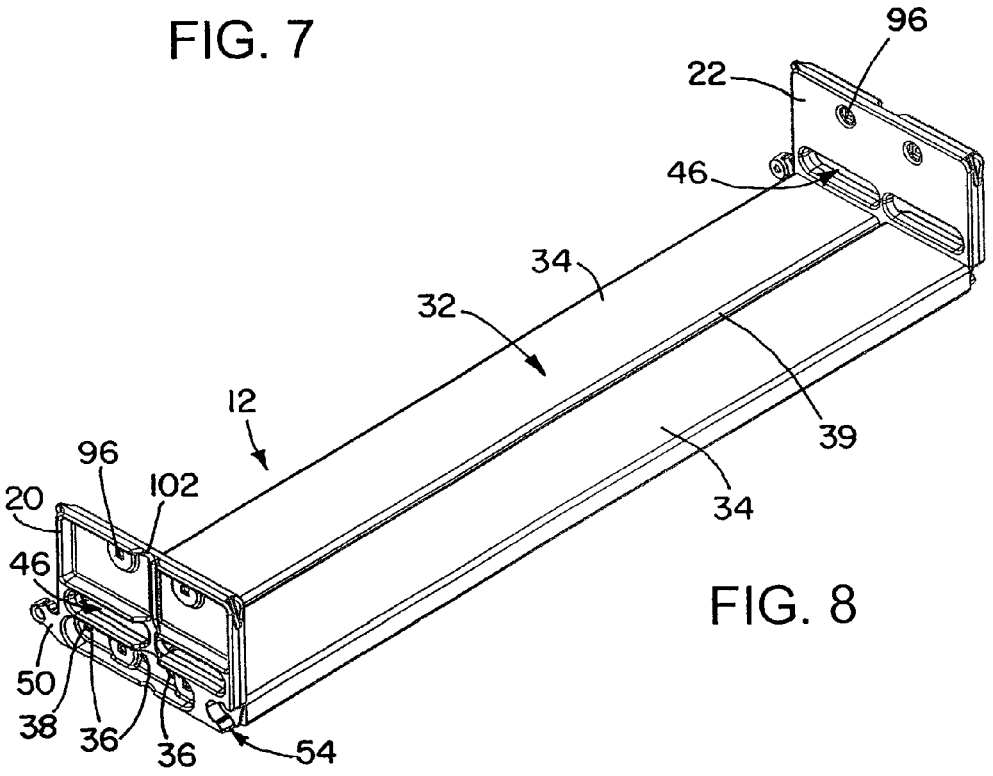
FIG. 8 is an enlarged perspective view of one of the modular ramp units of FIGS. 1 and 2.

In an embodiment, the respective ends 28, 30 of the wood boards 34 must be attached to the inwardly facing sides 24, 26 of the side edge plates 20, 22 before the posts 88 are attached to the outwardly facing sides 92, 94 of the side edge plates because the post mounting brackets 98 cover up two of the wood screw holes 38 as shown in FIG. 7.

Figure 16:
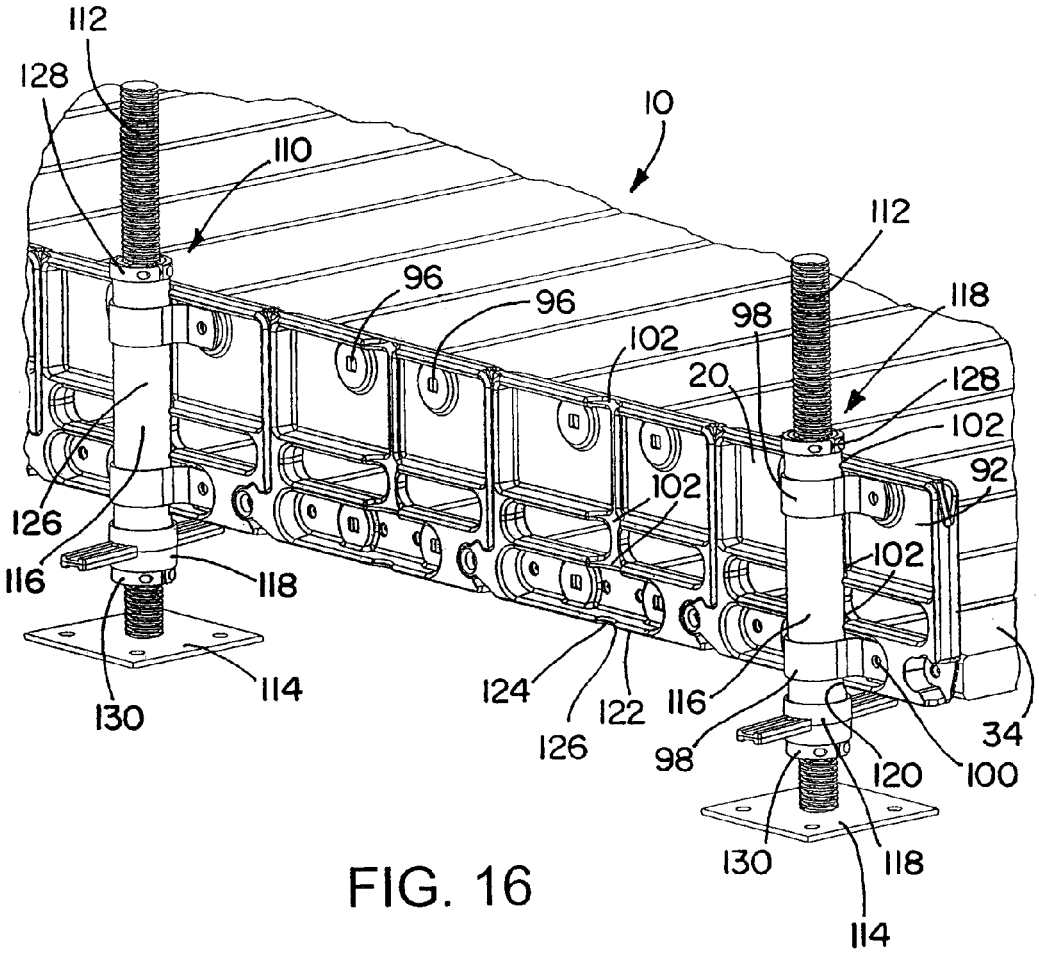
FIG. 16 is a fragmentary enlarged upper left side perspective view of an embodiment of a portable modular pedestrian ramp in which one or more screw jack assemblies are used to support longer ramps.
Figure 17:
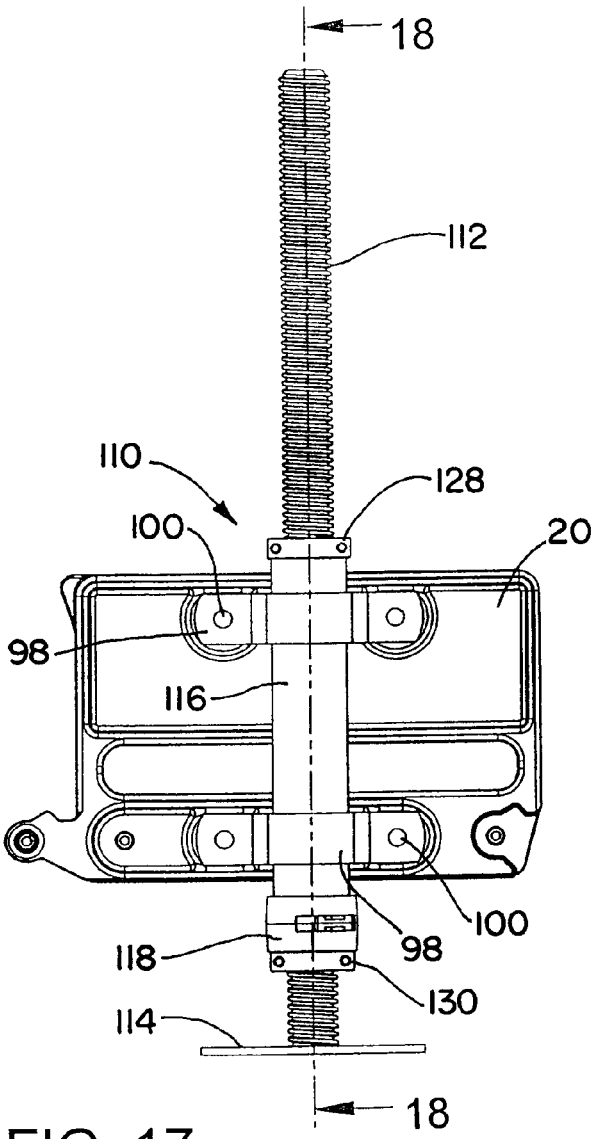
FIG. 17 is an enlarged front elevation view of one of the side edge plates of one of the modular ramp units to which one of the screw jack assemblies is attached.
Figure 18:
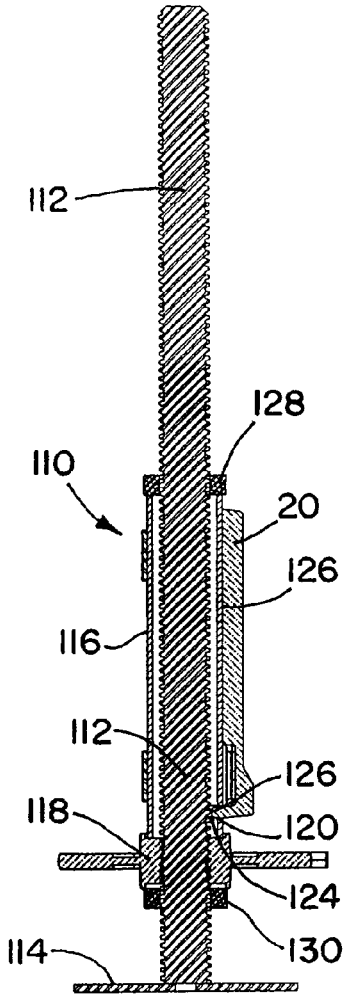
FIG. 18 is a longitudinal section through the screw jack assembly and side edge plate of FIG. 17, taken on the plane of the line 18-18 thereof.

In an embodiment shown in FIGS. 16-18, one or more screw jack assemblies 110 are used to support longer ramps 10 on jobs to accommodate greater elevation changes or maintain a specific elevation of the walkway surface of longer ramps.

In this embodiment, each screw jack assembly 110 comprises a jack screw 112 affixed at its lower end to a base plate 114 for supporting the jack screw on a flat surface, and a tubular jack screw mount 116 through which the jack screw freely extends. The jack screw mount 116 is supported on the jack screw 112 by a wing nut 118 that is threaded onto the jack screw before the jack screw mount is inserted over the jack screw.

Figure 19:
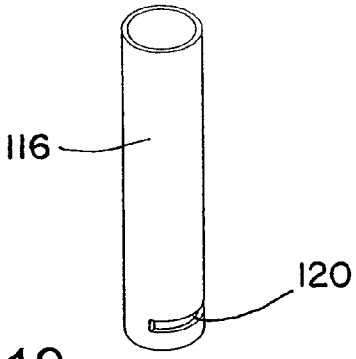
FIG. 19 is a perspective side view of the tubular jack screw mount of the screw jack assembly of FIGS. 16-18.

Adjacent the lower end of the jack screw mount 116 is an arcuate notch 120 (see FIGS. 16, 18 and 19) that is sized for receipt of a portion of the bottom outer edge 122 of the outwardly facing sides 92, 94 of the side edge plates 20, 22 of at least one modular ramp unit 12 for transfer of the weight of the ramp to the jack screw assembly 110 as shown in FIG. 18.

In an embodiment, an arcuate groove 124 is provided in the bottom outer edge 122 of the outwardly facing sides 92, 94 of the side edge plates in alignment with the arcuate grooves 102 of one or more modular ramp units 12 for locating the screw jack mounts 116 when attached to the respective side edge plates using the same or different brackets 98 and carriage bolts 100 used to attach the handrail posts 88 to the side edge plates as shown in FIGS. 16 and 17.

In an embodiment, the portion of the bottom outer edge 122 of the outer side edge plates that is received in the arcuate notch 120 of the jack screw mounts 116 comprises an edge 126 of the arcuate groove 124. Also the arcuate groove 124 is shallower than the other arcuate grooves 102 to provide a clearance between the edge 126 of the shallower arcuate groove 124 and the jack screw 112 inside the jack screw mount as shown in FIG. 18.

As will be apparent, rotating the wing nut 118 in opposite directions will cause the wing nut to lift or lower the weight of the ramp 12 supported thereby. Depending on the weight of the ramp, portions of the ramp may have to be lifted sufficiently to provide a clearance space between the bottom of the jack screw mount 116 and the wing nut 118 for ease of turning of the wing nut in either direction.

In an embodiment, once the weight of the ramp 10 is properly supported by one or more of the screw jack assemblies 110 at the desired height, a U-shape clamp 128 resting on top of the jack screw mount 116 is tightened to prevent further raising of the screw jack assemblies, and another U-shape clamp 130 located below the wing nut 118 is moved up against the bottom of the wing nut and tightened to prevent further lowering of the screw jack assemblies to lock the screw jack assemblies in place.

Although the invention has been shown and described with respect to certain embodiments, it is obvious that equivalent alterations and modifications will occur to others skilled in the art upon reading and understanding of the specification. In particular, with regard to the various functions performed by the above-described components, the terms (including any reference to a "means") used to describe such components are intended to correspond, unless otherwise indicated, to any component which performs the specified function of a described component (e.g., that is functionally equivalent), even though not structurally equivalent to the disclosed component which performs the function of the herein illustrated exemplary embodiments of the invention. In addition, while a particular feature of the invention may have been disclosed with respect to a particular embodiment, such feature may be combined with one or more other features as may be desired or advantageous for any given or particular application.

What is claimed is:

1. A portable modular pedestrian ramp, comprising:

a plurality of modular ramp units, each of the modular ramp units comprising a pair of side edge plates each having inwardly facing sides to which opposite ends of decking are attached, the side edge plates of at least some of the modular ramp units having opposite ends that are releasably connectable to one another by self-locking connectors to provide different ramp lengths to accommodate different elevations between two surfaces without the need for any tools or fasteners to join the modular ramp units together or disassemble the modular ramp units for transportation and storage, wherein the respective self-locking connectors comprise an arm at one end of the respective side edge plates that angles upwardly and has a cylindrical shaped outer end, and an upwardly angled slot in an other end of the respective side edge plates that is wider than the arm at the one end for ease of insertion of the cylindrical shaped outer end of the arm of the respective side edge plates of one of the modular ramp units into a complementary shaped semi-cylindrical recess at an inner end of the wide angled slot at the other end of the respective side edge plates of an other of the modular ramp units when the arm and slot of the modular ramp units are angularly aligned relative to one another, and the wide angled slot has a notch in an upper edge thereof that is engageable by a complementary shaped projection on an upper edge of the arm of the one modular ramp unit when the other end of the one modular ramp unit is lifted upwardly relative to the other modular ramp unit to lock the modular ramp units together.

2. The pedestrian ramp of claim 1 wherein when the notch in the upper edge of the wide angled slot in the side edge plates of the other modular ramp unit is fully engaged by the projection on the upper edge of the arm of the side edge plates of the one modular ramp unit, adjacent ends of the side edge plates of the modular ramp units substantially abut one another.

3. The pedestrian ramp of claim 1 wherein the decking comprises one or more boards that are attachable to the inwardly facing side of the respective side edge plates adjacent a bottom edge thereof by screws extending through screw holes in the respective side edge plates, and wherein one of the screw holes extends coaxially into the semi-cylindrical recess at the inner end of the wide angled slot in the other end of the respective side edge plates.

4. The pedestrian ramp of claim 1 wherein the decking comprises one or more boards having opposite ends that are attachable to the inwardly facing side of the respective side edge plates by screws extending through screw holes in the respective side edge plates, wherein one of the screw holes extends coaxially into the semi-cylindrical recess at the inner end of the wide angled slot in the other end of the respective side edge plates, and a coaxial hole extends through the cylindrical shaped outer end of the arm at the one end of the respective side edge plates that is aligned with the screw hole that extends into the semi-cylindrical recess at the inner end of the wide angled slot in the other end of the respective side edge plates when the cylindrical shaped outer end of the arm of the one modular ramp unit is inserted into the wide angled slot of the other modular ramp unit for insertion of one of the screws through the aligned holes and screwing of the one screw into one end of the board to secure the board to the respective side edge plates of the modular ramp units.

5. The pedestrian ramp of claim 1 further comprising a top ramp unit that is shorter than the modular ramp units for ease of placement of the top ramp unit at a higher elevation, wherein the decking comprises one or more boards that are attachable to the inwardly facing side of the respective side edge plates adjacent a bottom edge of the respective side edge plates of the modular ramp units by screws extending through screw holes in the respective side edge plates, and wherein the top ramp unit comprises a pair of shorter side edge plates having opposite ends, a board attachable to inwardly facing sides of the respective shorter side edge plates adjacent a bottom edge thereof by screws extending through screw holes in the respective shorter side edge plates, a socket in an outwardly facing side of the respective shorter side edge plates adjacent one end thereof for axial sliding receipt of an axial outer end portion of the cylindrical shaped outer end of the arm of the modular ramp units, and wherein one of the screw holes in the shorter side edge plates extends coaxially into the socket in the respective shorter side edge plates, and the cylindrical shaped outer end of the arm of the modular ramp units has a coaxial hole that is aligned with the socket screw hole in the shorter side edge plates when the axial outer end portion of the cylindrical shaped outer end of the arm of one of the modular ramp units is inserted into the socket for insertion of one of the screws through the aligned holes and screwing into an end of the board to attach the board to the inwardly facing side of the respective shorter side edge plates and securely connect one of the modular ramp units to the shorter ramp unit.

6. The pedestrian ramp of claim 5 wherein the inwardly facing side of the respective shorter side edge plates of the shorter ramp unit has a shelf adjacent a bottom edge thereof for supporting the board thereon and a flange at the end opposite the socket for locating the board relative to the shorter side edge plates.

7. The pedestrian ramp of claim 1 further comprising approach plates hingedly connected to outermost end edges of the decking at opposite ends of the pedestrian ramp.

8. The pedestrian ramp of claim 7 further comprising slip-resistant grip tape covering the decking and approach plates.

9. The pedestrian ramp of claim 1 wherein the side edge plates have a height of eight or more inches to provide guidance for disabled pedestrians using canes or walking devices.

10. The pedestrian ramp of claim 1 wherein the decking comprises one or more wood boards attached to the inwardly facing sides of the respective side edge plates of the modular ramp units by wood screws extending through wood screw holes in the respective side edge plates.

11. The pedestrian ramp of claim 10 further comprising a shelf on the inwardly facing sides of the respective side edge plates below the screw holes for supporting opposite ends of the wood boards.

12. The pedestrian ramp of claim 1 wherein at least some of the modular ramp units have a length of approximately one foot allowing an installer to add or remove one foot increments to or from the length of the ramp on a job as needed for a given application.

13. The pedestrian ramp of claim 12 wherein the outwardly facing sides of the side edge plates have at least two axial spaced arcuate grooves orthogonal to a bottom edge of the side edge plates for locating handrail posts on the side edge plates.

14. The pedestrian ramp of claim 13 further comprising carriage bolt holes extending through the side edge plates on opposite sides of the arcuate grooves for receipt of carriage bolts for attaching metal straps to the outwardly facing sides for securing the handrail posts to the side edge plates.

15. The pedestrian ramp of claim 1 further comprising one or more jack screw assemblies for supporting the ramp intermediate its length.

16. A portable modular pedestrian ramp comprising:

a plurality of modular ramp units, each of the modular ramp units comprising a pair of side edge plates each having inwardly facing sides to which opposite ends of decking are attached, the side edge plates of at least some of the modular ramp units having opposite ends that are releasably connectable to one another by self-locking connectors to provide different ramp lengths to accommodate different elevations between two surfaces without the need for any tools or fasteners to join the modular ramp units together or disassemble the modular ramp units for transportation and storage, and a shelf on the inwardly facing sides of the respective side edge plates below the screw holes for supporting opposite ends of the wood boards, wherein the decking comprises one or more wood boards attached to the inwardly facing sides of the respective side edge plates of the modular ramp units by wood screws extending through wood screw holes in the respective side edge plates, wherein the decking of at least some of the modular ramp units comprises two wood boards that are located relative to one another against the inwardly facing sides of the respective side edge plates by a rib on the inwardly facing sides that extends orthogonal to the shelf.

17. A portable modular pedestrian ramp comprising:

a plurality of modular ramp units, each of the modular ramp units comprising a pair of side edge plates each having inwardly facing sides to which opposite ends of decking are attached, the side edge plates of at least some of the modular ramp units having opposite ends that are releasably connectable to one another by self-locking connectors to provide different ramp lengths to accommodate different elevations between two surfaces without the need for any tools or fasteners to join the modular ramp units together or disassemble the modular ramp units for transportation and storage, and a locator projection at a top end edge at one end of the respective side edge plates that engages a corresponding slot at the top end edge of the other end of the respective side edge plates when adjacent ends of the side edge plates of the modular ramp units are joined together.

18. A portable modular pedestrian ramp comprising:

a plurality of modular ramp units, each of the modular ramp units comprising a pair of side edge plates each having inwardly facing sides to which opposite ends of decking are attached, the side edge plates of at least some of the modular ramp units having opposite ends that are releasably connectable to one another by self-locking connectors to provide different ramp lengths to accommodate different elevations between two surfaces without the need for any tools or fasteners to loin the modular ramp units together or disassemble the modular ramp units for transportation and storage, and one or more lack screw assemblies for supporting the ramp intermediate its length, wherein each of the one or more jack screw assemblies comprises a jack screw having a lower end affixed to a base plate, a wing nut threaded onto the jack screw, a tubular jack screw mount through which the jack screw freely extends, the jack screw mount being supported by the wing nut for raising and lowering of the jack screw mount relative to the jack screw upon turning of the wing nut in opposite directions, an arcuate slot adjacent a lower end of the jack screw mount sized for receipt of a portion of a bottom outer edge of the outwardly facing sides of the side edge plates of one or more modular ramp units for transfer of the weight of the ramp to the jack screw assemblies, and clamp means for affixing the jack screw mount to the outwardly facing sides of the side edge plates of one or more of the modular ramp units.

19. The pedestrian ramp of claim 18 further comprising axially spaced arcuate grooves in the outwardly facing sides of the side edge plates of the one or more modular ramp units for receipt of portions of an outer tubular wall of the screw jack mount, wherein the portion of the bottom outer edge of the outer side edge plates that is received in the arcuate notch adjacent the lower end of the jack screw mount comprises an edge of one of the arcuate grooves that is in the bottom outer edge of the outwardly facing sides of the side edge plates, wherein the arcuate groove in the bottom outer edge is shallower than the other arcuate grooves to provide a clearance between the edge of the shallower arcuate groove and the jack screw inside the jack screw mount.

* * * * *